US010722091B2

(12) United States Patent
Policicchio

(10) Patent No.: US 10,722,091 B2
(45) Date of Patent: Jul. 28, 2020

(54) CLEANING ARTICLE WITH PREFERENTIALLY COATED TOW FIBERS

(71) Applicant: The Procter & Gamble Company, Cincinnati, OH (US)

(72) Inventor: Nicola John Policicchio, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 190 days.

(21) Appl. No.: 15/726,534

(22) Filed: Oct. 6, 2017

(65) Prior Publication Data

US 2019/0104909 A1 Apr. 11, 2019

(51) Int. Cl.
*A47L 13/17* (2006.01)
*A47L 13/38* (2006.01)
*A47L 13/255* (2006.01)

(52) U.S. Cl.
CPC ..... *A47L 13/17* (2013.01); *A47L 13/255* (2013.01); *A47L 13/38* (2013.01)

(58) Field of Classification Search
CPC ..... A47L 13/17; A47L 13/255; A47L 13/38
See application file for complete search history.

(56) References Cited

U.S. PATENT DOCUMENTS 823,725 A 6/1906 Hayden
3,494,821 A 2/1970 Evans
3,629,047 A 12/1971 Davison
4,144,370 A 3/1979 Boulton
4,145,787 A 3/1979 Bastian
4,808,467 A 2/1989 Suskind et al.
5,144,729 A 9/1992 Austin et al.
5,364,657 A * 11/1994 Throne ..... B05D 3/00 427/185
5,525,397 A 6/1996 Shizuno et al.
5,691,035 A 11/1997 Chappell et al.
6,143,393 A 11/2000 Abe et al.
6,241,835 B1 6/2001 Abe et al.
6,245,413 B1 6/2001 Fujiwara et al.
6,319,593 B1 11/2001 Kenmochi et al.
6,329,308 B1 12/2001 Kenmochi et al.
6,550,092 B1 4/2003 Brown et al.
6,554,937 B1 4/2003 Kenmochi et al.
6,774,070 B1 8/2004 Kenmochi et al.
6,777,064 B1 8/2004 Brown et al.
6,797,357 B2 9/2004 Fereshtehkhou et al.
6,813,801 B2 11/2004 Tanaka et al.
6,830,801 B1 12/2004 Kenmochi et al.
6,936,330 B2 8/2005 Fereshtehkhou et al.
6,984,615 B2 1/2006 Kenmochi et al.
7,003,856 B2 2/2006 Hayashi et al.
(Continued)

OTHER PUBLICATIONS

PCT Search Report for application No. PCT/US2018/053057, dated Dec. 7, 2018, 12 pages.

*Primary Examiner* — Shay Karls
(74) *Attorney, Agent, or Firm* — John T. Dipre

(57) ABSTRACT

A cleaning article for cleaning a target surface. The cleaning article has tow fibers attached to a carrier sheet. The tow fibers are advantageously provided with an exterior coating. The coating is applied in an amount sufficient to be efficacious, but not wasteful or which leaves residue. The amount of coating is correlated with the amount of moisture in the tow.

3 Claims, 10 Drawing Sheets

(56) References Cited

U.S. PATENT DOCUMENTS

| | | | |
|---|---|---|---|
| 7,291,359 | B2 | 11/2007 | Haskett et al. |
| 7,386,907 | B2 | 6/2008 | Otsuka et al. |
| 7,560,398 | B2 | 7/2009 | Zillig et al. |
| 7,566,671 | B2 | 7/2009 | Hoadley et al. |
| 7,682,686 | B2 | 3/2010 | Curro et al. |
| 7,712,178 | B2 | 5/2010 | Yamada et al. |
| 7,779,502 | B2 | 8/2010 | Fujiwara et al. |
| 7,786,030 | B2 | 8/2010 | Tsuchiya |
| 7,803,726 | B2 | 9/2010 | Policicchio et al. |
| 7,838,099 | B2 | 11/2010 | Curro et al. |
| 7,870,635 | B2 | 1/2011 | Yamada et al. |
| 7,937,797 | B2 | 5/2011 | Tsuchiya et al. |
| 8,075,977 | B2 | 12/2011 | Curro et al. |
| 8,093,192 | B2 | 1/2012 | Liu et al. |
| 8,146,197 | B2 | 4/2012 | Yamada |
| 8,151,402 | B2 | 4/2012 | Takabayashi et al. |
| 8,161,001 | B2 | 4/2012 | Di Carlo et al. |
| 8,161,594 | B2 | 4/2012 | Policicchio et al. |
| 8,225,453 | B2 | 7/2012 | Yamada |
| 8,245,349 | B2 | 8/2012 | Tsuchiya et al. |
| 8,435,625 | B2 | 5/2013 | Ruehe et al. |
| 8,528,151 | B2 | 9/2013 | Przepasniak |
| 8,536,074 | B2 | 9/2013 | Fereshtehkhou et al. |
| 8,617,685 | B2 | 12/2013 | Yamada |
| 8,646,144 | B2 | 2/2014 | Wada et al. |
| 8,752,232 | B2 | 6/2014 | Otsuka et al. |
| 8,756,746 | B2 | 6/2014 | Policicchio |
| 8,763,197 | B2 | 7/2014 | Policicchio et al. |
| 8,793,832 | B2 | 8/2014 | Yamada |
| 8,851,776 | B2 | 10/2014 | Schwarz et al. |
| 9,113,768 | B2 | 8/2015 | Wada et al. |
| 9,198,553 | B2 | 12/2015 | Policicchio |
| 9,204,775 | B2 | 12/2015 | Pung et al. |
| 9,296,176 | B2 | 3/2016 | Escaffre et al. |
| 9,339,165 | B2 | 5/2016 | Vetter et al. |
| 2003/0171051 | A1 | 9/2003 | Bergsten et al. |
| 2006/0051434 | A1* | 3/2006 | Tsuchiya ..... A01N 25/34 424/725 |
| 2006/0171764 | A1 | 8/2006 | Hoadley et al. |
| 2008/0028560 | A1 | 2/2008 | Policicchio et al. |

* cited by examiner

CLEANING ARTICLE WITH PREFERENTIALLY COATED TOW FIBERS

FIELD OF THE INVENTION

The present invention relates to cleaning articles having tow fibers with an effective amount of coating thereon.

BACKGROUND OF THE INVENTION

Various cleaning articles have been created for dusting and light cleaning. For example, cloth rags and paper towels used dry or wetted with polishing and cleaning compositions have been used on relatively flat surfaces such as countertops, showers, sinks and floors. Laminiferous wipes have been proposed, as disclosed in U.S. Pat. No. 9,296,176. But, rags, wipes, and paper towels are problematic for reasons such as hygiene (the user's hands may touch chemicals, dirt or the surface during cleaning), reach (it may be difficult to insert the user's hand with the rag, wipe or paper towel into hard-to-reach places) and inconvenience (cleaning between closely-spaced articles typically requires moving the articles).

To overcome the problems associated with using rags and paper towels, various reusable dust gathering devices using felt and hair have been utilized for more than a century, as illustrated by U.S. Pat. No. 823,725 issued in 1906 to Hayden and using yarns as illustrated in U.S. Pat. No. 4,145,787. To address the problems with reusable dust gathering devices, disposable cleaning articles have been developed which have limited re-usability. These disposable cleaning articles may include synthetic fiber bundles, called tow fibers, attached to a sheet as shown in U.S. Pat. Nos. 6,241,835; 6,329,308; 6,554,937; 6,774,070; 6,813,801; 7,003,856; 7,566,671; 7,712,178; 7,779,502; 7,937,797; 8,146,197; 8,151,402; 8,161,594, 8,186,001; 8,245,349; 8,646,144; 8,528,151; 8,617,685; 8,756,746; 8,763,197; 9,113,768 and 9,198,553.

Disposable dusters having tow fibers may provide for wet cleaning as disclosed in U.S. Pat. No. 7,566,671 and in commonly assigned U.S. Pat. No. 7,803,726 and commonly assigned US 2008/0028560. But tow fibers may become matted when wet and not be suitable for cleaning a large or heavily wetted surface, such as a floor. Thus, dusters may not suitable for cleaning extremely large or heavily soiled surfaces.

Instead, sheets having fibers have been proposed, as disclosed in U.S. Pat. Nos. 6,143,393; 6,241,835; 6,319,593; 6,329,308; 6,554,937; 6,774,070; 6,830,801; 7,870,635; 8,225,453; 8,646,144; 8,617,685; 8,752,232; 8,793,832; 9,113,768 and in commonly assigned U.S. Pat. No. 8,075,977. Webs with elastic behavior have been proposed in commonly assigned U.S. Pat. No. 5,691,035. Sheets with recesses have also been proposed, as disclosed in U.S. Pat. Nos. 6,245,413; and 7,386,907. Sheets with cavities have been proposed, as disclosed in U.S. Pat. No. 6,550,092. An adhesive cleaning sheet is proposed in U.S. Pat. No. 7,291,359. Tufts are taught in commonly assigned U.S. Pat. Nos. 7,682,686, 7,838,099 and/or 8,075,977.

Yet other attempts use coatings of wax and/or oil. Coatings, such as wax and oil are generally disclosed in U.S. Pat. Nos. 6,550,092; 6,777,064; 6,797,357; 6,936,330; 6,984,615; 7,386,907; 7,560,398; 7,786,030; 8,536,074; 9,204,775; 9,339,165. Specific amphiphilic coatings are disclosed in U.S. Pat. No. 8,851,776. Swiffer® Dusters, sold by the instant assignee, have been sold with up to 7 weight percent oil for off-the-floor cleaning. U.S. Pat. No. 7,786,030 discusses various percentages of antigenicity compositions as applied to a cleaning tool. For example, U.S. Pat. No. 7,786,030 teaches using a dry lubricant having 5.0% moisture solublized in the lubricant. But U.S. Pat. No. 7,786,030 does not teach how moisture can affect tow fibers in a cleaning article or what control over moisture levels in the tow fibers is desired.

But these teachings do not address the proper amount of coatings on a cleaning article having tow fibers attached to a sheet. Too little coating is not efficacious. Too much coating is wasteful, contaminates production machinery and can leave unsightly residue. Residue is problematic as it leave the surface intended to be cleaned with a dirty appearance and can be difficult to remove.

Yet other factors should be considered. For example, the presence of water in tow fibers may lead to cohesive failure, further exacerbating the problem of depositing residue on the surface to be cleaned. But the prior art neither teaches the optimal coating weight of mineral oil to balance soil pickup performance against residue, nor the effect of moisture on the desired coating weight.

Accordingly, this invention addresses the problem of how to incorporate the proper amount of coating onto the tow fibers of a cleaning article.

SUMMARY OF THE INVENTION

The present invention, in one embodiment, relates to a cleaning article for cleaning a target surface. The cleaning article including a carrier sheet having a first surface and second surface opposed thereto and a tow fiber bundle joined to the first surface of the carrier sheet. The tow fiber bundle having an oil coating of about 6 to about 15 w % disposed thereon and the tow fiber bundle having about 1.5 weight percent moisture or less.

In another embodiment, the present invention relates to a cleaning article for cleaning a target surface. The cleaning article including a carrier sheet having a first surface and second surface opposed thereto and a tow fiber bundle joined to the first surface of the carrier sheet. The tow fiber bundle having an oil coating of about 6 to about 15 w % disposed thereon and the tow fiber bundle further containing a moisture level bounded by the inequality $M<-0.05C+2$, where C is the weight percentage of coating on the tow and M is the weight percentage of moisture in the tow fiber bundle and $0.5<M<1.7$.

The present invention further encompasses a cleaning article for cleaning a target surface. The cleaning article including a carrier sheet having a first surface and second surface opposed thereto and a tow fiber bundle joined to the first surface of the carrier sheet. The tow fiber bundle having an oil coating of about 6 to about 15 w % disposed thereon and the tow fiber bundle further containing a moisture level bounded by the inequality $C<30M+5$, wherein C is the weight percentage of oil coating on the tow fibers and M is the weight percentage of moisture in the tow fibers, and $0.5<M<1.7\%$ for an oil coating of about $6<C<15\%$.

BRIEF DESCRIPTION OF THE DRAWINGS

The drawings are to scale unless designated as schematic.

DETAILED DESCRIPTION OF THE INVENTION

Figure 1:
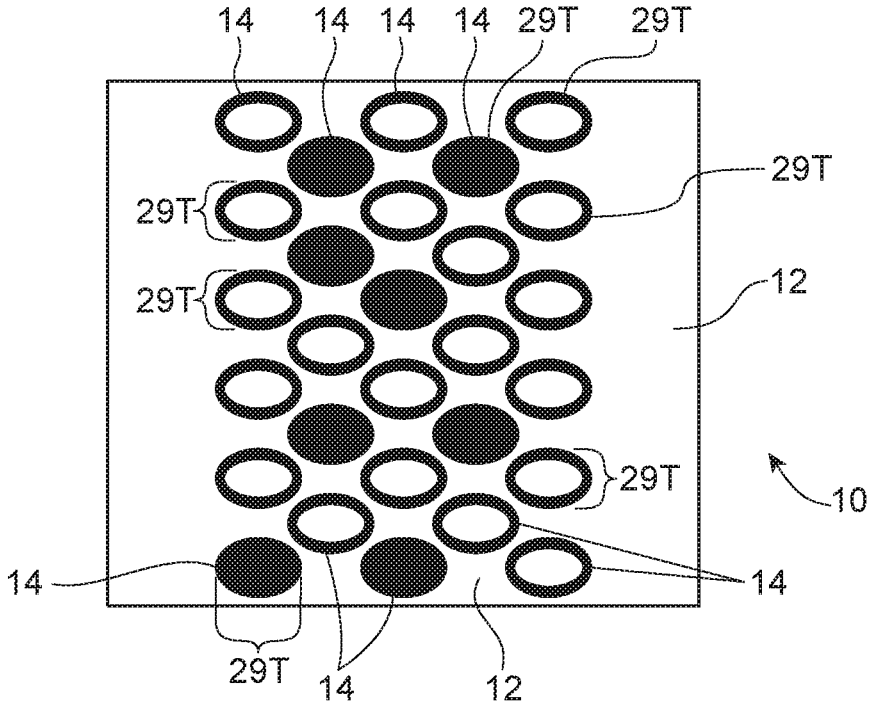
FIG. 1 is a schematic top perspective view of a cleaning article according to the present invention and having discrete tufts, the tufts being both solid and hollow.

Referring to FIGS. 1-3A, the cleaning article 10 may be generally elongate, and rectangular, although other shapes are contemplated and feasible. The cleaning article 10 may comprise two or more components joined in a laminate form to provide cleaning article 10 suitable for floor cleaning. The cleaning article 10 may have a carrier sheet 12, which forms a frame for attachment of other components thereto. The cleaning article 10 may also have a cleaning strip element 25, having one or more layers 27 of stacked, outwardly extending, flexible strips 17. A bundle of tow fibers 14 is superimposed on the strips 17 and oriented transversely thereto. An optional absorbent core may be disposed between the cleaning strip element 25 and the sheet 12.

The cleaning article 10 may be disposable. By disposable it is meant that the cleaning article 10 may be used for one cleaning task, or generally for not more than several square meters, then discarded. In contrast, a reusable cleaning article 10 is laundered or otherwise restored after use.

The cleaning article 10 may have a longitudinal axis LA and a transverse axis TA orthogonal thereto. The cleaning article 10, and respective components thereof, may have two longitudinal edges 20 parallel to the longitudinal axis LA and two transverse edges 22 parallel to the transverse axis TA.

The length of the cleaning article 10 is taken in the longitudinal direction. The width of the cleaning article 10 corresponds to the transverse direction perpendicular to the length direction and disposed within the plane of the sheet 12. The thickness is defined as the dimension in the Z-direction. The XY plane is defined as the plane defined by the cleaning article 10. The Z-direction of the cleaning article 10 is the direction perpendicular to the plane of the cleaning article 10. The cleaning article 10 may have a length from 20 to 50 cm and a width of 10 to 20 cm. The cleaning article 10 may particularly be 30+/−2 cm long by 14+/−2 cm wide, as measured at the greatest dimensions, in order to fit the head of a typical cleaning implement 70, as discussed below. An optional core may particularly have a width of 6.5+/−2 cm and a length of 26+/−2 cm. Of course, one of skill will recognize that other shapes are feasible and within the scope of the present invention.

The cleaning article 10 may have an outwardly facing cleaning side and an attachment side opposed thereto. The cleaning article 10 is intended to be used dry, although damp cleaning where incidental moisture may occur is contemplated and with the scope of the present invention.

More particularly, the cleaning article 10 may comprise a construction of at least one tow fiber bundle and at least one carrier sheet. The tow fiber bundle and cleaning strip element 25 are joined in face-to-face relationship with at least one permanent bond 38 to form a laminate. The tow fiber bundle(s) may be distended from and protrude outwardly from the plane of the cleaning strip element 25. This arrangement prophetically provides the benefit that larger particles may be captured by the tow fibers 14. If desired, the cross section of the bundle of tow fibers 14 may be thicker in the Z direction as the longitudinal axis LA is approached, increasing the prophetic benefit of allowing large particle entry.

The carrier sheet 12 may serve as a chassis for attachment of the cleaning strip element 25 thereto. The carrier sheet 12 may particularly comprise a synthetic nonwoven sheet 12. A carrier sheet 12 having synthetic fibers provides for convenient joining of the tow fibers 14 thereto. Nonwovens include spun bonded, carded and airlaid materials, as are known in the art and made from synthetic fibers. A suitable nonwoven sheet may be made according to commonly assigned U.S. Pat. No. 6,797,357. The carrier sheet 12 may optionally comprise a polyolefinic film, or a microfiber and be liquid pervious or impervious.

The carrier sheet 12 may comprise cellulose, to provide absorptive capacity. A cellulosic sheet 12 may have permanent wet strength resin added thereto, as is known in the art. Or the carrier sheet 12 may preferably comprise a mixture of cellulosic and synthetic fibers, to provide both absorptive and barrier properties, and for convenient joining of the cleaning strip element 25. By cellulosic it is meant that the component comprises a predominant weight percentage of cellulosic fibers.

The carrier sheet 12 may comprise a hydroentangled spunbond nonwoven with a basis weight of 20 to 80 gsm. A 45 gsm nonwoven from Avgol Nonwovens of Tel-Aviv, Israel has been found suitable. The carrier sheet 12 may comprise a laminate of two, three or more plies joined together using adhesive and/or thermal bonds 38 as are known in the art. Optional attachment stripes of loop or similar material may be joined to the attachment side to removably join the cleaning article 10 to a handle 60 or implement 70. One or more plies may comprise a microfiber, particularly a nylon microfiber, as is known in the art.

Tow fibers 14 are a component in Swifter® Dusters™ sold by the instant assignee. The tow fibers 14 may be synthetic, comprising polymers including polyester, polypropylene, polyethylene, bio-derived polymers such as polylactic acid, bio-polyethylene, bio-polyester and the like. Tow fibers 14 may also include fibers from natural sources such as cellulose, cellulose acetate, flax, hemp, jute and mixtures thereof manufactured wherein the individual fibers are relatively long strands manufactured in bundles. Preferred tow fibers 14 are bicomponent fibers having a PP or PE core with a polyethylene sheath.

The tow fibers 14 may be defined as fibers having distinct end points and being at least about 1 cm, preferably at least about 3, more preferably at least about 4 and more preferably at least about 5 cm in length. The tow fibers 14 may extend continuously and in a substantially transverse direction, between the transverse edges of the article 10.

The carrier sheet 12 and tow fiber bundle(s) 29 may be joined by a plurality of permanent bonds 38. The bonds 38 are intended to minimize or prevent stray or dislodged tow fibers 14 from becoming loose. Such sheets 12 and tow fiber bundle(s) may typically be directly superimposed on one another, with or without intervening members or components therebetween.

One suitable form of tow fiber bundles 29 comprises tufts 29T. The carrier sheet 12 and tow fiber bundles 29 may have bonds 38 and cuts 39 therebetween to form the discrete tufts 29.

Figure 1A:
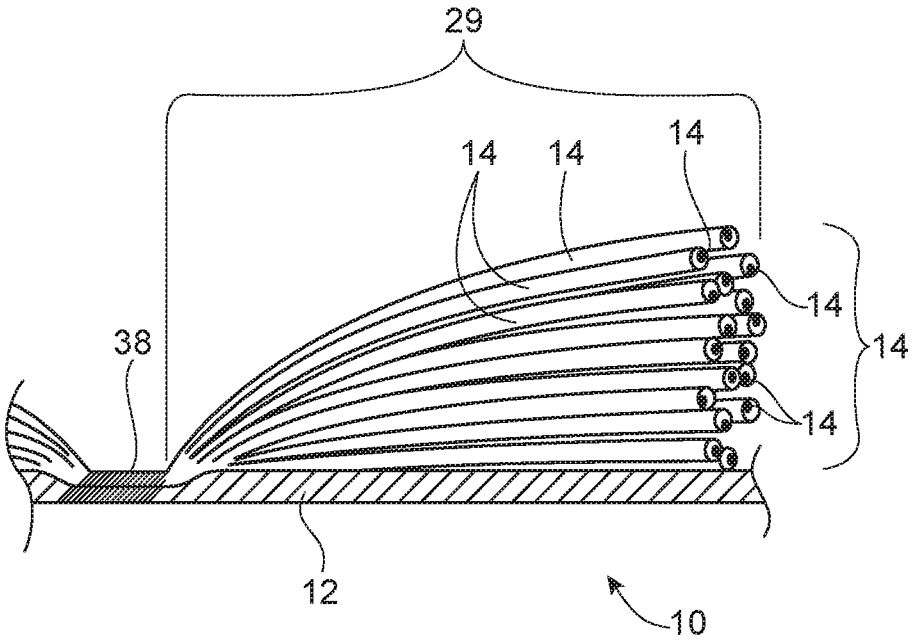
FIG. 1A is a fragmentary vertical sectional view of a discrete tuft schematically showing a uniform coating thereon.

Referring particularly to FIGS. 1 and 1A, the cleaning article 10 may have the tow fiber bundles 29 disposed in a grid of discrete tufts 29T. The discrete tufts 29T may be made in known fashion by discretely bonding the tow fiber bundles 29 to the carrier sheet 12. The carrier sheet 12 and tow fiber bundles 29 are then cut through at discrete slits 39, to form the tufts 29T between the bonds 38 and the slits 39.

Referring particularly the FIG. 1A, the coating is shown as being uniform and circumscribing the individual tow fibers 14. It is to be understood, the coating may comprise discrete droplets disposed on a tow fiber, rings of oil which do not extend longitudinally along an individual fiber for an appreciable distance, and combinations thereof.

Figure 2:
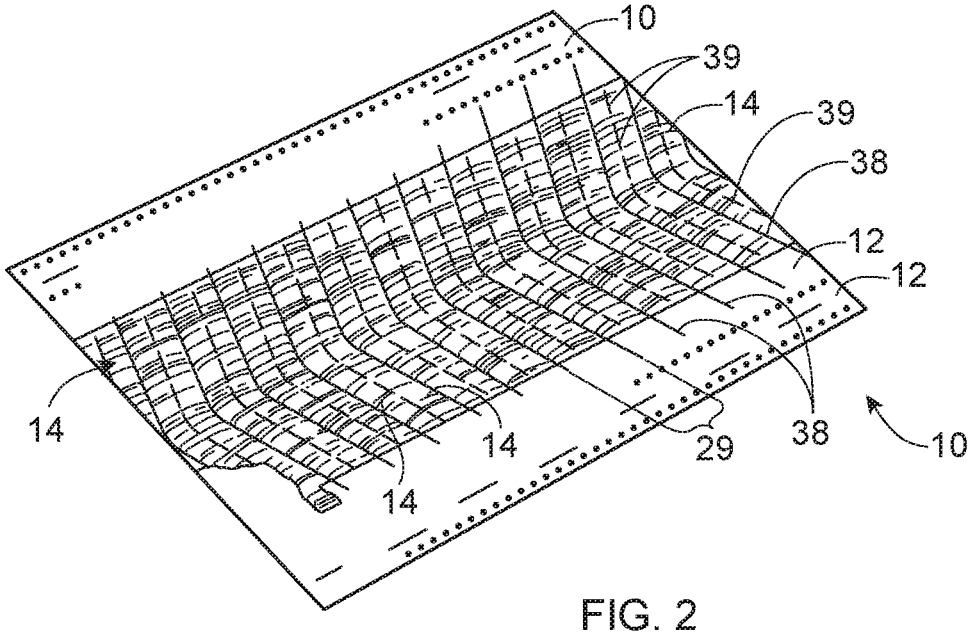
FIG. 2 is top perspective view of a variant embodiment of a cleaning article according to the present invention having tow fibers disposed in a V-shaped pattern.
Figure 3:
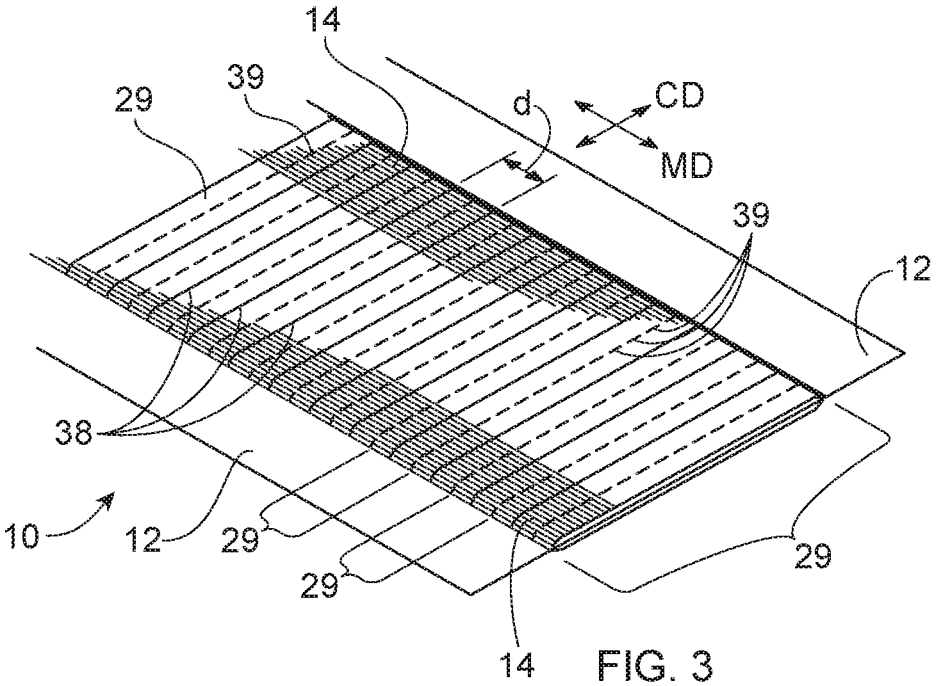
FIG. 3 is a top perspective view of a variant embodiment of a cleaning article according to the present invention having tow fibers with bridge portions.
Figure 3A:
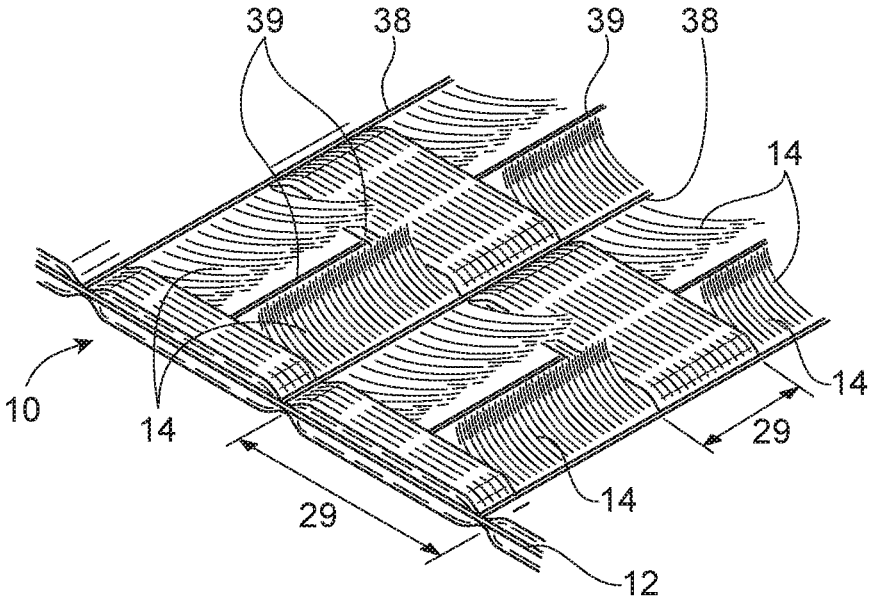
FIG. 3A is an enlarged fragmentary view of the tow fibers of FIG. 3.

Referring particularly to FIGS. 2-3A, the cleaning article 10 may have tow fiber bundles 29 disposed in spaced apart lines. The lines may be V-shaped, straight, serpentine, curvilinear, etc. as desired. Discrete slits 39 between the lines form tufts 29T, as described above.

Referring particularly to FIGS. 3 and 3A, the tow fiber bundles 29 may optionally form tow fiber bridges. The tow fiber bridges are formed by tow fibers 14 which are bonded at spaced apart bonds 38 and are not cut or slit between the bonds 38. Prophetically, the tow fiber bridges capture debris which may not be captured by discrete tufts 29T. The slits 39 and/or bonds 38 may be spaced on a uniform pitch or a nonuniform pitch, as desired.

Figure 4:
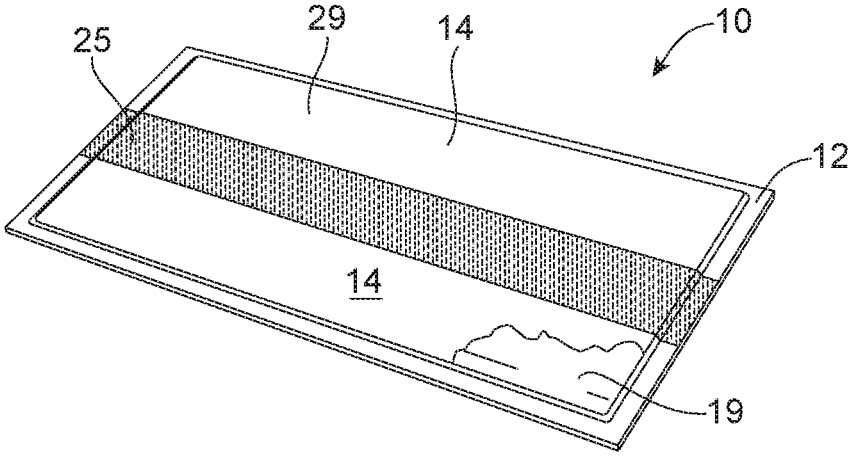
FIG. 4 is a top perspective view of a variant embodiment of a cleaning article according to the present invention having tow fibers and a cleaning element, shown partially in cutaway.

Referring to FIG. 4, the cleaning article 10 may comprise an optional cleaning element 25. The cleaning strip element 25 may comprise a polyolefinic film, having integral protrusions as disclosed in commonly assigned U.S. Pat. No. 8,407,848. The cleaning strip element 25 may preferably comprise a mixture of wet laid fibers formed into a tissue which is bonded onto a synthetic nonwoven using a process such as spun lace or hydroentangling. The cleaning element 25 may particularly comprise a 23 gsm tissue with a 17 gsm polypropylene spunbond as a composite, sold under the name Genesis tissue by Suominen of Helsinki, Finland. Or, the cleaning strip element 25 and/or the sheet 12 may alternatively or additionally comprise nylon microfiber. The cleaning article 10 may further comprise an absorbent core 19, as is known in the art. The absorbent core may be cellulosic and contain AGM.

Referring to FIGS. 5A-5D, the cleaning article 10 may comprise opposed rows of hydrophilic cleaning strips 17 disposed in a cleaning strip element 25. As used herein, cleaning strips 17 refer to strips extending outwardly from proximal ends to respective distal ends. The individual cleaning strips 17 may have a proximal end at or offset from the longitudinal centerline of the article 10, and having a length (taken in the transverse direction) greater than the corresponding width (as taken in the longitudinal direction), to provide an aspect ratio of at least 1 and optionally 2 to 20, and optionally 5 to 15. The cleaning strips 17 may have a length, taken from a respective proximal end juxtaposed with a bond 38 to a respective distal end, which may be juxtaposed with a longitudinal edge 20 of the cleaning article, of 3 to 15, 4 to 12 or particularly 5 to 8 cm, and a width of 3 to 20, 4 to 15 or particularly 6 to 8 mm. These particular dimensions have been found suitable for use in floor cleaning, when using a cleaning implement.

The cleaning strips 17 lie within the XY plane as intended by manufacture, although may be deformed out of the XY plane due to fluffing before use, and/or deformations which occur in use due to movement against the target surface. The cleaning strips 17 may be incorporated into one of the sheets 12 described herein or may be deployed on a separate sheet 12. The cleaning strips 17 may extend parallel to the width direction of the article, or may be disposed in acute angular relationship thereto. The cleaning strips 17 may be straight, as shown, curved, serpentine or of any desired shape.

While the cleaning article 10 may have cleaning strips 17 throughout the longitudinal extent of the cleaning article 10, one of skill will recognize the invention is not so limited. Or the cleaning strips 17 may be disposed along any portion of the longitudinal edges.

If desired, the strips 25 may be made of a fibrous woven or nonwoven sheet having high bulk or terry cloth-like properties. The cleaning strip element 25 may preferably comprise polypropylene spunbond as a composite, such as the aforementioned Genesis tissue by Suominen of Helsinki, Finland. The carrier sheet 12 and cleaning strips 17 may be joined by a plurality of bonds 38, as set forth below. The bonds 38 may be thermal, adhesive or ultrasonic, etc. as are known in the art.

With continuing reference to FIGS. 5A-5D, an elongate tow fiber bundle may be disposed in a rope or channel oriented generally parallel to the longitudinal axis LA. Such an elongate tow fiber bundle may be oriented transverse the cleaning strips 17. By transverse, it is meant that the tow fibers 14 have a major axis that is oriented at least 30, preferably at least 45 and more preferably about 90 degrees to the major axis of the strips 17. This arrangement reduces the chance of undesired entanglement of the tow fibers 14 and strips 17, while allowing for mobility of the strips 17 and, as desired static positioning or mobility of the tow fiber bundle 29.

An elongate tow fiber bundle may be disposed in a sharp zig-zag or sinusoidal pattern, both collectively referred to as serpentine. This arrangement provides the benefit that the tow fibers 14 are disposed at different positions relative to the longitudinal axis and prophetically provide better cleaning for different sizes of particulates. If such serpentine pattern is selected, the repeats may have a constant or variable wavelength, amplitude and tow fiber bundle thickness. The tow fiber bundle may be of variable width in the X direction, parallel to the transverse axis TA. This arrangement prophetically provides the benefit of more surface area in the forward/backward sweeping directions to intercept particles. This arrangement also provides different effective lengths for the cleaning strips 17, prophetically improving dynamic surface area presented to the target surface. Prophetically an hourglass shaped tow fiber 29, as shown in FIG. 3E1, may funnel particles to the center of the cleaning article 10.

Figure 5A:
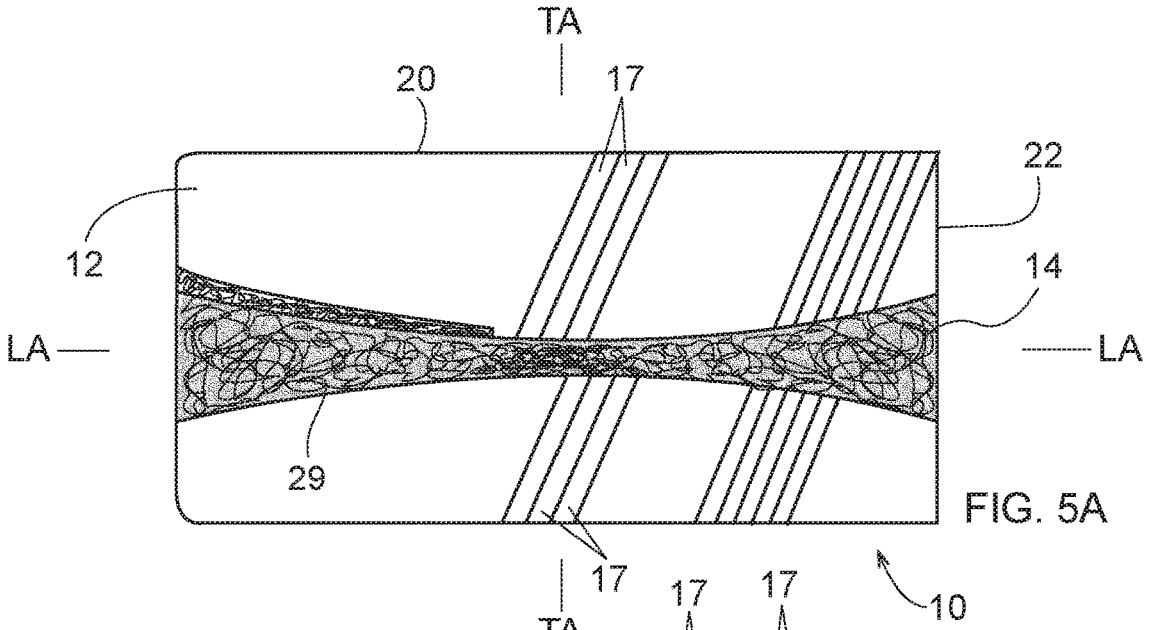
FIG. 5A is a schematic bottom plan view of a cleaning article having a variable width hourglass shaped tow fiber bundle and optional diagonally oriented strips, with one side having strips of constant length and one side having strips of variable length.
Figure 5B:
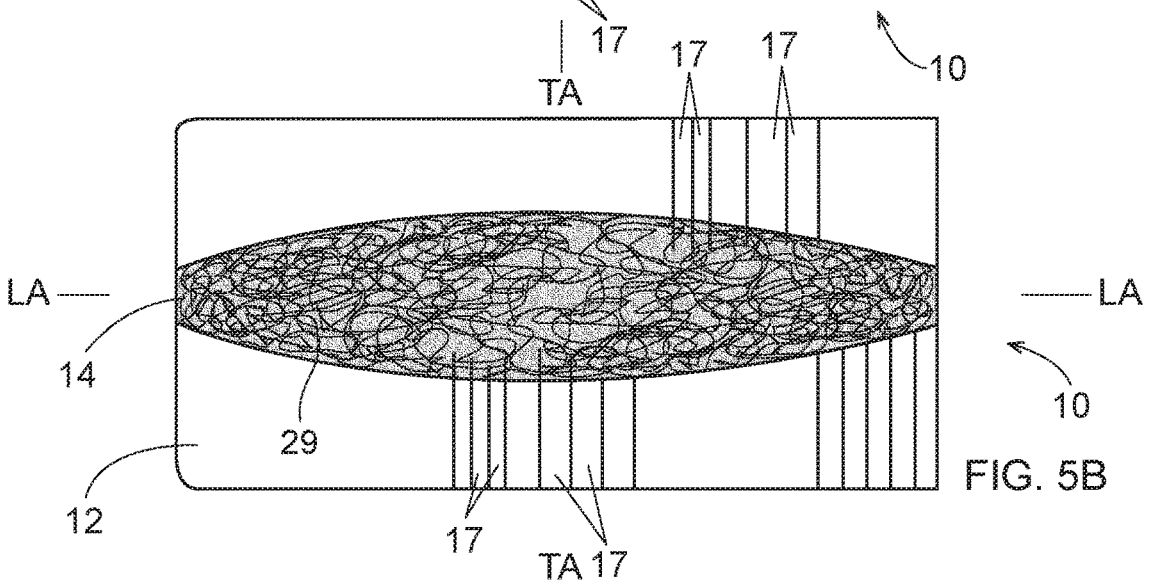
FIG. 5B is a schematic bottom plan view of a cleaning article having a variable width barrel shaped tow fiber bundle and optional strips with variable width and variable length.
Figure 5C:
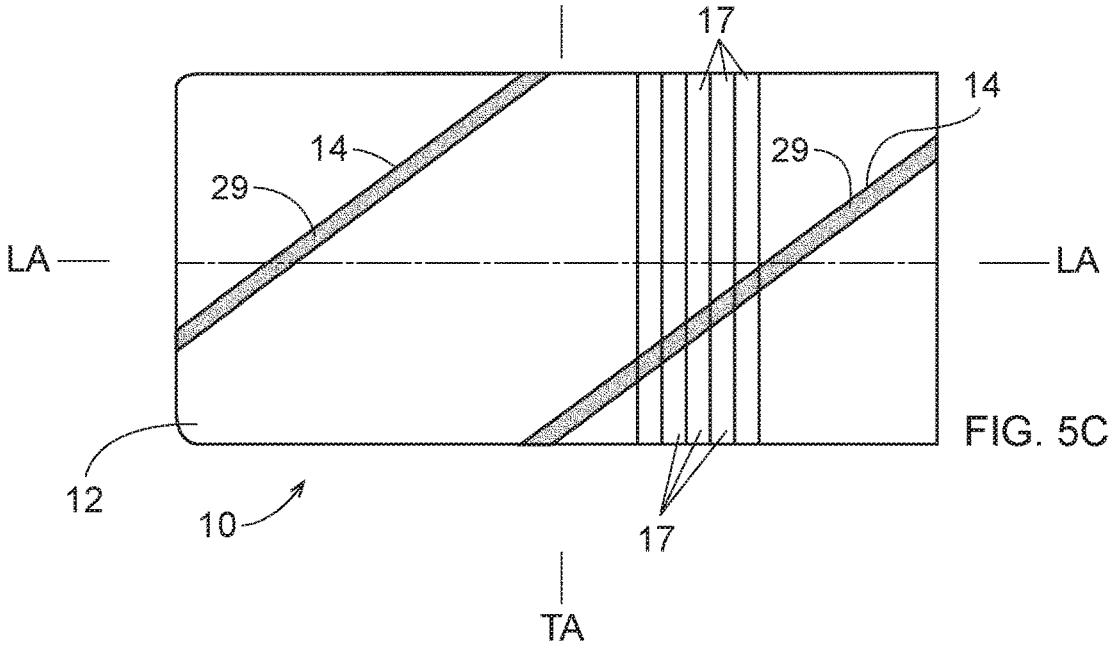
FIG. 5C is a schematic bottom plan view of a cleaning article having plural tow fiber bundles diagonally oriented relative to the longitudinal axis and which fully cover the longitudinal dimension of the cleaning article and optional strips.

Referring particularly to FIG. 5C, plural tow fiber bundles 29 may be diagonally oriented relative to the longitudinal axis LA. Preferably the tow fiber bundles 29 fully cover the longitudinal dimension of the cleaning article 10, so that the entire length of the cleaning article 10 advantageously intercepts particles. If such an embodiment is selected, preferably no portion of the cleaning article 10 has a line in the transverse direction which does not intercept a tow fiber bundle 29.

Figure 5D:
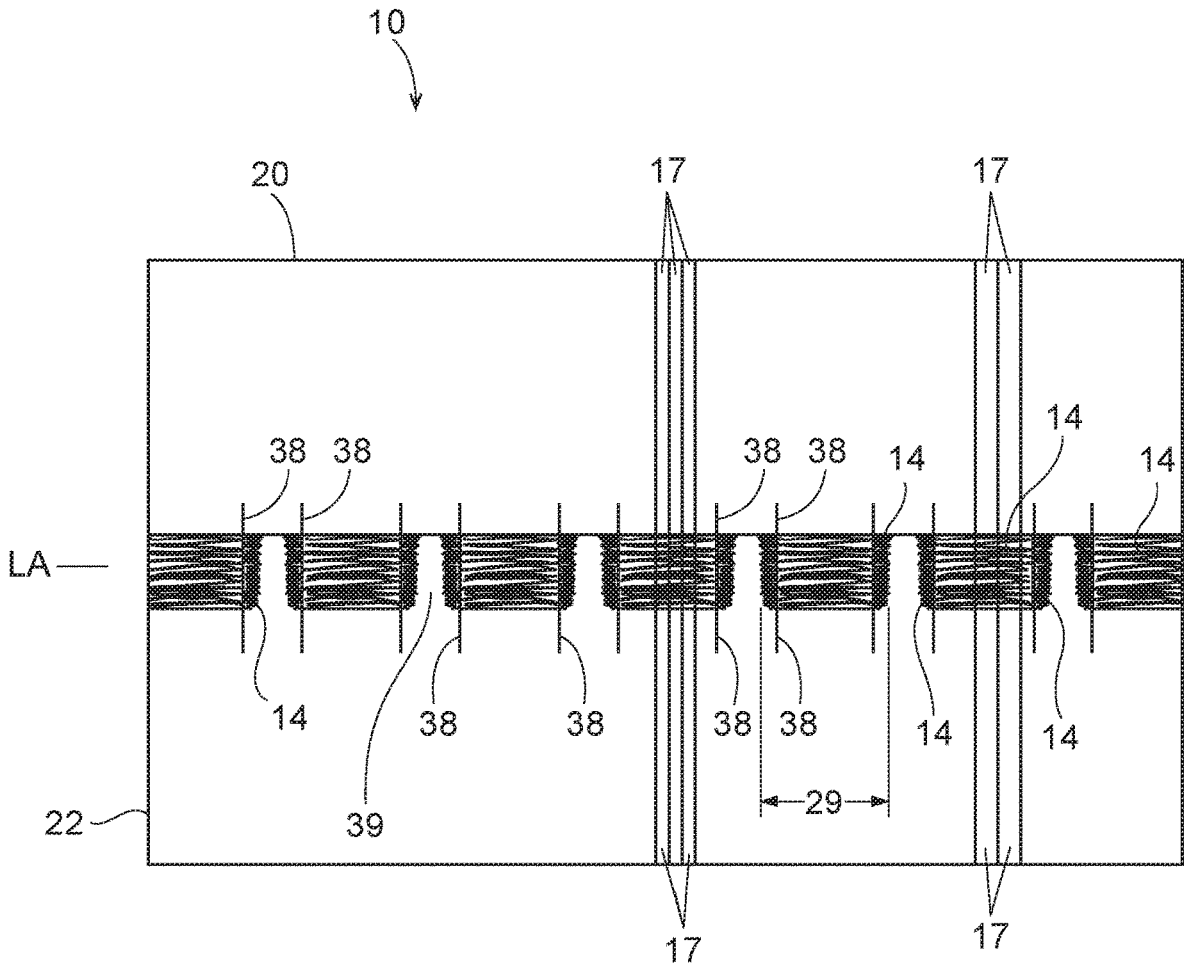
FIG. 5D is a schematic bottom plan view of a cleaning article having spaced apart bonds and the tow fiber bundle cut intermediate the spaced bonds and optional strips.

Referring particularly to FIG. 5D, an elongate tow fiber bundle may have discrete bonds 38 which are spaced apart in the longitudinal direction. The tow fiber bundle may be cut intermediate the bonds 38. This arrangement provides tow fibers 14 extending from proximal ends at the bonds 38 to respective distal ends. The distal ends are free and can move against the target surface. This arrangement is believed to promote efficacious cleaning as the tow fibers 14 present dynamic movement to the target surface.

The bonds 38 may be generally perpendicular to the longitudinal axis LA, or may be skewed relative thereto. Likewise, the cuts 39 intermediate the bonds 38 may be generally perpendicular to the longitudinal axis LA, or may be skewed relative thereto. Prophetically cuts 39 oblique to the longitudinal axis LA provide the benefit of differential length tow fibers 14. The bonds 38 may be longitudinally spaced apart as desired. Prophetically a pitch of 0.5 to 6 cm, or 1 to 3 cm, would be feasible, providing tow fibers 14 with a cut length of 1 to 6 cm.

The bond(s) 38 may be formed by adhesive bonding, thermal bonding, ultrasonic bonding, etc. In thermal bonding and ultrasonic bonding, energy and compressive pressure are applied to local bond 38 sites. The synthetic sheet 12 and synthetic tow fibers 14 are melted at such local sites. Upon refreezing, the local materials of sheet 12 and tow fibers 14 are refreeze together at such local sites, forming localized welds which are the bonds 38.

Figure 6:
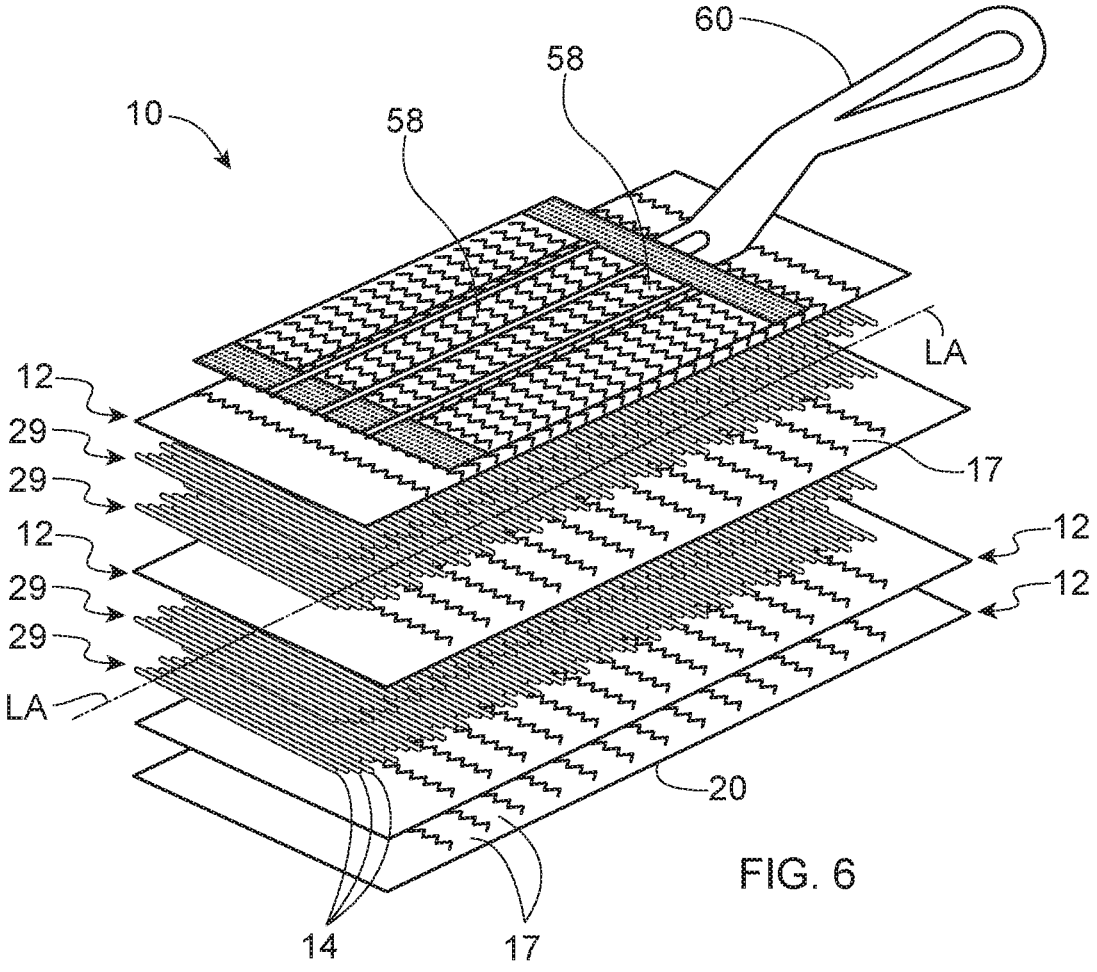
FIG. 6 is an exploded perspective view of a cleaning article known as a duster, and having sleeves, plural layers of tow fibers laminated to plural carrier sheets and having an optional handle.

Referring to FIG. 6, the cleaning article may 10 comprise a laminate of one or more carrier sheets 12 and tow fibers 14 transverse the carrier sheet(s) 12. Two or more carrier sheets 12 may be stacked, with one or more layers of tow fibers 14 disposed on either side of the stacked carrier sheets 12. Such cleaning article 10 may optionally have strips 17, as desired.

Figure 11:
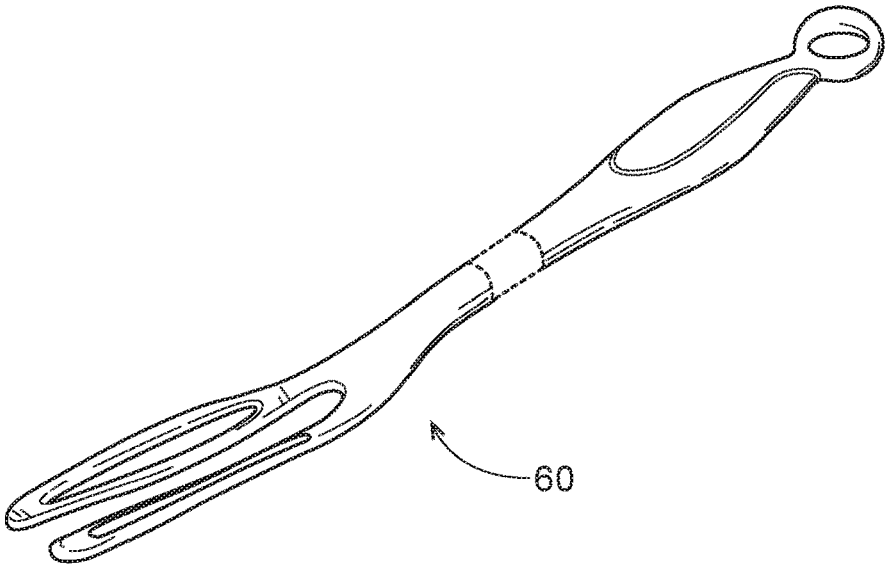
FIG. 11 is a perspective view of a handle usable with the present invention.
Figure 12A:
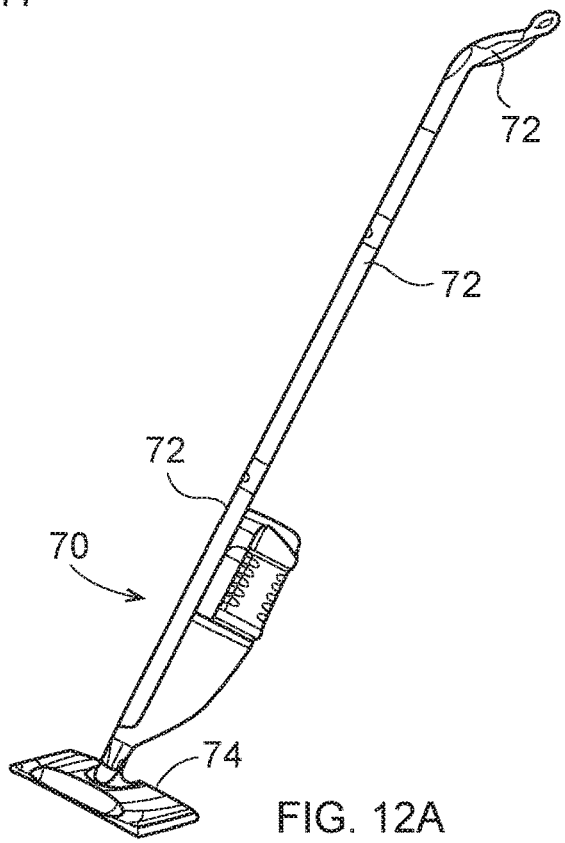
FIG. 12A is a perspective view of a floor cleaning implement usable with the present invention having a schematic cleaning article attached thereto.
Figure 12B:
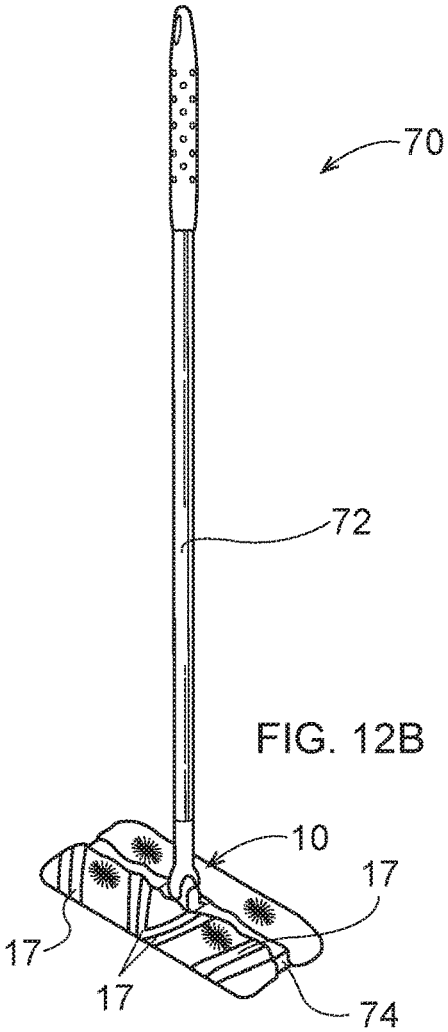
FIG. 12B is a perspective view of a floor cleaning implement usable with the present invention and having an optional spray system.

A bond 28 may extend throughout a spine of the longitudinal dimension of the cleaning article 10. Other bonds 38 may be disposed outboard of the spine, to form attachment sleeves 58 between the stacked carrier sheets 12. The attachment sleeves 58 may receive a handle 60, as discussed below with respect to FIG. 11.

Referring generally to any of FIGS. 1-6, the carrier sheet 12 may optionally be completely or partially coated with adhesive, wax, Newtonian oils and/or non-Newtonian oils or a combination thereof, in order to improve cleaning and increase retention of absorbed debris.

Particularly, the tow fiber bundle 29, in any configuration, may be coated with a mineral oil coating. The coating may comprise a mixture of mineral oil and surfactant at a ratio of about 90% to 10% oil to surfactant. The non-aqueous surfactant provides the benefit inducing the oil to wet the tow fibers 14 by reducing the surface energy. The non-aqueous surfactant may be a non-ionic surfactant.

Using non-aqueous based surfactant is preferred as the presence of water in the surfactant is believed to reduce the cohesive properties of the oil mixture. Thus, a greater amount of oil might come off the tow fibers 14 even at lesser coating amounts, leading to residue on the target surface.

Suitable oil has a surface tension of less than 35, 33, 31, 32, 30, 29, or 28 mN/m. If helpful, the surface tension of the oil may be surfactant modified to yield the desired surface tension. Generally a surface tension between 22 and 30 mN/m has been found preferable as providing suitable spreading on the tow fibers 14, without undue contamination of the target surface.

Surface tension is measured at 20 degrees C. using ASTM D1331-14, Method A (Surface Tension by du Nouy ring). duNouy Tensiometer. A TD Series Tensiometer available from LAUDA Scientific GmbH may be used for this measurement.

The oil coating may comprise oil, a blend of oil and surfactant, and may optionally particularly contain a silicone surfactant, fluorosurfactant, trimethicone, etc. Such additives can be used to reduce surface tension without adversely affecting the coating percentages described herein. Surface tension reducing additives are believed to be valuable for improving uniform coating distribution on the fibers. Prophetically, using less additives reduces cohesive failure, and reduces oil residue All such additives are included in the oil coating weights described and claimed herein.

Applicant has investigated 10 different oils, both with and without surface tension reducing additives. These oils yield the surface tensions shown in Table 1 below.

TABLE 1

| Sample # | Lubricant | Surface Tension Changing Additive | Surface tension [mN/m] @20 Degrees C. |
|---|---|---|---|
| 1 | IGI<br>100% standard grade mineral oil | None | 35* |
| 2 | IGI Blend<br>90% standard oil + 10% non-ionic | Non-ionic | 33 |

TABLE 1-continued

| Sample # | Lubricant | Surface Tension Changing Additive | Surface tension [mN/m] @20 Degrees C. |
|---|---|---|---|
| 3 | Parol 500 P oil 100% cosmetic grade | none | 33 |
| 4 | Fancol poylyisobutylene 800 oil 100% cosmetic grade | none | 30 |
| 5 | IGI Blend 89.1% oil + 9.9% non-ionic | Silcare 3I M60 caprylyl trimethicone 1% | 31 |
| 6 | Parol 500 P 99% oil | Silcare 3I M60 caprylyl trimethicone 1% | 32 |
| 7 | IGI Blend 89.1% oil + 9.9% non-ionic | Zonyl FSD Fluorosurfactant 1% | 22 |
| 8 | Parol 500 P 99% oil | Zonyl FSD Fluorosurfactant 1% | 20 |
| 9 | IGI Blend 89.1% oil + 9.9% non-ionic | Abil EM90 Silicone surfactant 1% | 28 |
| 10 | Parol 500 P 99% oil | Abil EM90 Silicone surfactant 1% | 29 |

*Estimated based on literature

A blend of 90% mineral oil and 10% non-ionic surfactant, available from The International Group, Inc., Toronto, Canada, has been found suitable. Or cosmetic grade Parol 500 P lubricant from Calumet Lubricants, Indianapolis, Ind. is suitable. Fancol Polyiso 800 CG cosmetic grade lubricant, from Fanning Corporation, Chicago, Ill. is suitable and has desirable surface tension without the addition of surfactants to reduce surface tension.

During manufacture, it may be advantageous to heat the oil surfactant mixture to less than about 200 centistokes @ 30 C to achieve more even distribution across the tow fibers 14. Viscosity is measured herein according to ASTM D445, ISO 3104.

Thus the coating may comprise an oil coating, comprising, consisting essentially of or consisting of an oil, particularly a mineral oil. If the oil coating includes a surfactant, the total mixture is included in the coating weight. The coating weight is determined as a weight percentage.

Preferably the oil coating is free of wax. Applicant has unexpectedly found wax may interfere with the improved debris collection provided by the oil coating of present invention.

The tow fibers 14 may have an oil coating of at least 6, 8, 9 or 10% and less than or equal to 19%, 15% or 13.5%, or any combination thereof or therebetween, according to the present invention. Particularly, the coating may consist essentially of mineral oil or consist essentially of mineral oil and nonionic surfactant, and further may be free of wax.

If the oil coating comprises non-ionic surfactant disposed in a mixture, such coating may comprise or consists essentially of 80 to 99 percent oil, 88 to 92 percent oil 85 to 95 percent oil or 90 percent oil and balance nonionic surfactant.

The invention was tested using cleaning articles 10 similar to those disclosed in the literature. Particularly, cleaning articles 10 were made according to the following specifications. Carrier sheets 12 having dimensions of 280×215 cm were used. Sixteen tow fiber bundles 29 having a cumulative width of 115 cm were joined to the carrier sheet in the longitudinal direction and ultrasonically bonded thereto with discrete bonds 38. Slits 39 were made through both the tow fiber bundles 29 and carrier sheet 12 in the transverse direction between each bond 38. Each cleaning article 10 had approximately 65 closely spaced, discrete tufts of tow fibers 14 formed thereby.

A roller was used to apply the desired oil coating percentage to the side of the cleaning article 10 having the tow fibers 14 using a compressive force of 3000±500 grams, to mimic a kiss-coating process as commonly in commercial production. Each such cleaning article 10 had about 0.05 to 0.1 grams of oil coating applied thereto. A 90% oil/10% nonionic surfactant coating was used.

The cleaning articles 10 were coated with the mineral oil coating at percentages of 0%, 6%, 9%, 12%, 15% and 18%. This experiment was run for n=3 samples of each percentage. The cleaning articles 10 were placed into a plastic bag and allowed to equilibrate within the bag for at least 48 hours at room temperature (20 C) and constant humidity between 45 to 55 RH.

The cleaning articles 10 were then tested for soil pick-up performance and residue left behind on a test surface. The test surface was clean ceramic tile having a surface area of 3.25 square meters. Dirt comprising three components was used: 1) dust, 2) low density soil including cellulose and 3) dense granular soil including rice. The three component were spread in the test surface in stripes of approximately one-third each.

Each cleaning article 10 was tared and attached to a Swifter® Sweeper™ cleaning implement. The test surface was then cleaned using a back and forth pattern. Each cleaning article 10 was reweighed and the tare subtracted to determine pickup. This test is repeated for a total of three cycles for each cleaning article 10. The total debris pickup for all three cycles was recorded in milligrams.

New cleaning articles 10 were tested for transfer of residue to the target surface. Each cleaning article was tared. The cleaning article 10 was placed with the tow fibers 14 facing downwardly on a test surface slightly larger than the cleaning article 10. The test surface was smooth hardwood coated with polyurethane.

A 600 g weight 28 cm×8 cm was placed on the center of the cleaning article 10 for 60 seconds. The cleaning article 10 was reweighed, to determined residue transfer in mg. This test was repeated for a total of three cycles for each cleaning article. The total coating transfer for three cycles was then tallied in mg. This experiment was run for n=3 samples of each test.

Referring to FIG. 6, the test data are graphically illustrated. Referring particularly to the upper line in FIG. 6, the test data show that debris pickup improves from 0% to about 6, 7, 8, or 9%. At coating weights of 9 to about 15%, debris pickup is relatively constant. Debris pickup improved slightly from 15 to 18%.

Referring particularly to the lower line in FIG. 6, the test data show that coating transfer as undesirable residue is generally acceptable at coating weights of 0% to about 15%. At coating weights greater than 15%, residue transfer exceeds 50 mg. Applicant has subjectively determined that 50 mg of coating transfer is the detectable limit of residue on the target surface and transfer greater than 50 mg impedes the cleaning article 10 performance.

Accordingly, and considering both the upper and lower lines in FIG. 6, it can be seen that optimal debris pickup without undue residue transfer occurs at oil coating weights of at least 6, 7, 8 or 9%, even more pickup occurs at oil coating weights of at least 9, 11 or 12%, and pickup improves even further from 15 to 18%. And to prevent undue residue accumulation, the coating weight may be less than 18%, 15% 12%, 10% or 9%.

Applicant has further discovered that the presence of moisture in the tow fibers 14 may lead to cohesive failure of the oil coating and cause undesirable residue on the target surface. Without being bound by theory, the inventors hypothesize that excess moisture occurring during manufacture of the tow fibers 14 and/or as an additive to the oil coating mixture may contribute to cohesive failure and undesirable residue. The tow fibers 14 are generally hydrophobic and preferentially bind like oil components.

To test this hypothesis, cleaning articles 10 were prepared as described above. One cleaning article 10 had tow fibers 14 with 7.5% oil coating and one cleaning article 10 had tow fibers 14 with 15% oil. Cleaning articles 10 were prepared at 0.5, 0.75, 1.0, 1.5 and 2.0% moisture levels. This experiment was run for n=3 samples of each test. These cleaning articles 10 were tested for residue, as described above.

Figure 7:
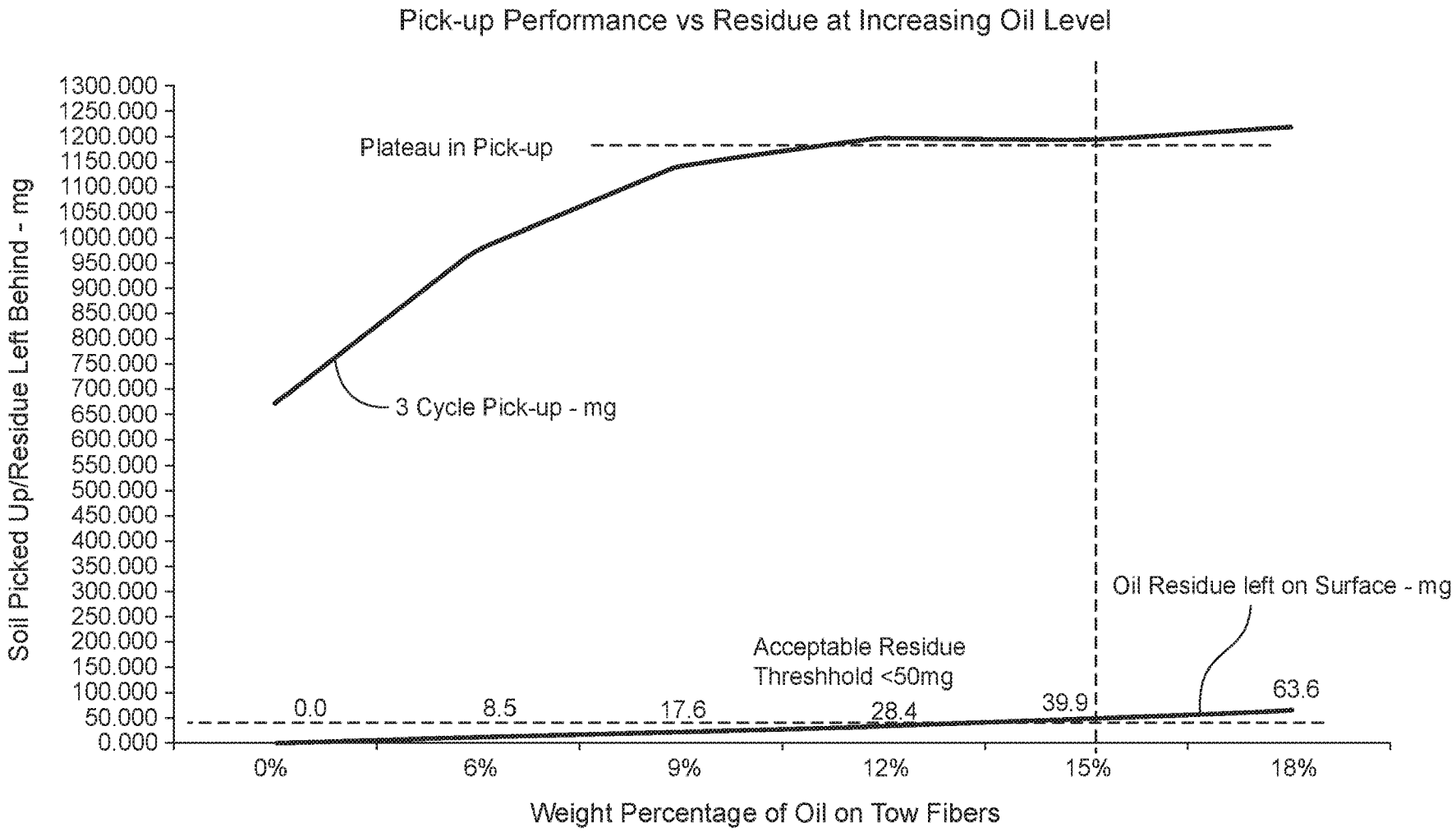
FIG. 7 is a graphical representation of pickup and residue cleaning performances as a function of coating weight percentage.

Referring to FIG. 7, it can be seen that soil pickup improves with increasing coating weight of the oil on the fibers 14. But, unfortunately, residue also and undesirably monotonically increases as a function of coating weight of the oil on the fibers 14. Applicant has unexpectedly found that for coating weights of 6-15 w %, 9-15 w %, 9-13.5 w %, 6-13.5 w %, 6-12 w % and 9-12 w % highly desirable soil pickup can be accomplished without the problem of residue.

Figure 8:
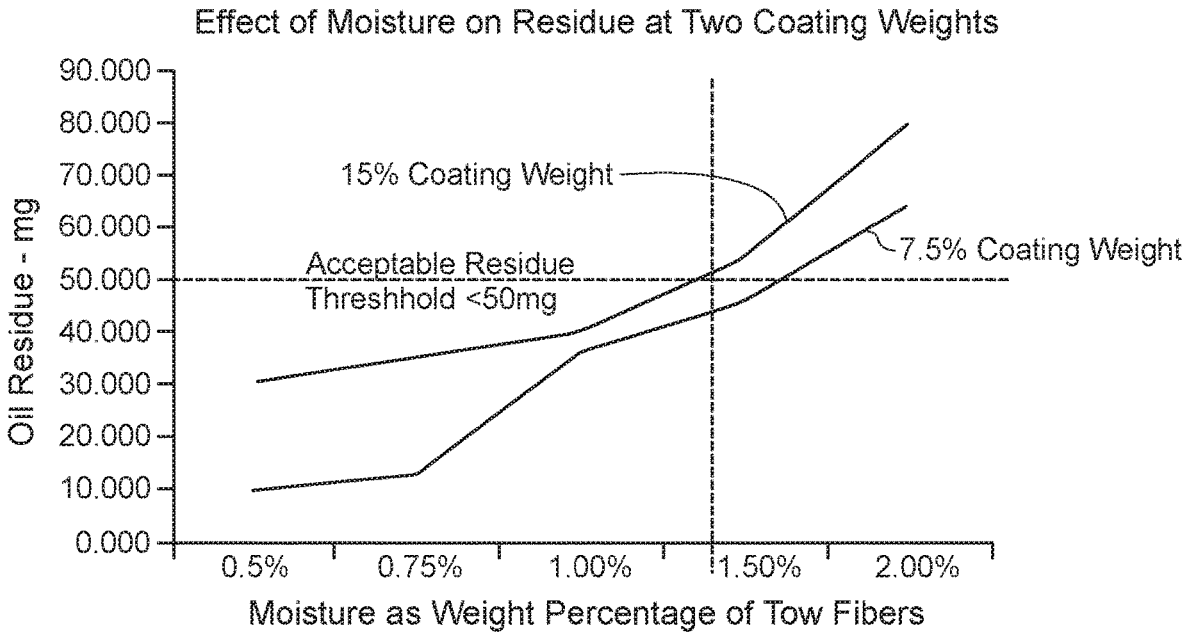
FIG. 8 is a graphical representation of residue cleaning performance as a function of tow moisture.

Referring to FIG. 8, it can be seen that for both 7.5% and 15% oil coating weights, residue monotonically increased as a function of the percentage of moisture in the tow fibers 14 29. For 7.5% coating weight, it can be seen that acceptable residue performance occurs at moisture levels of about 0.5 to about 1.7%. For 15% coating weight it can be seen that acceptable residue performance occurs at moisture levels of about 0.5 to about 1.3%.

Figure 9:
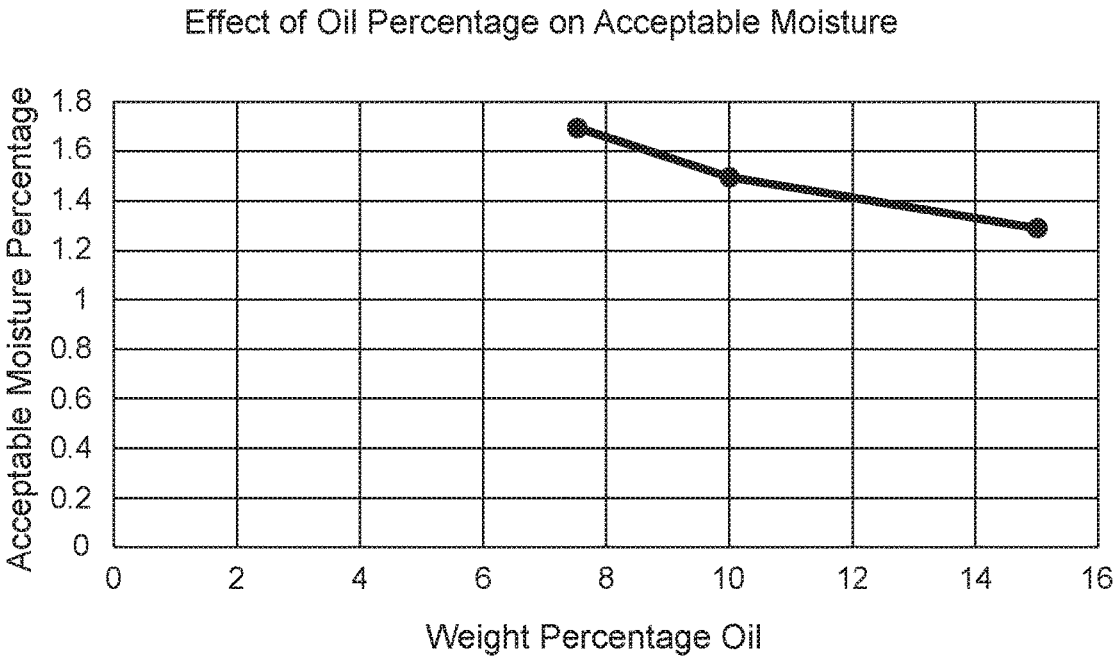
FIG. 9 is a graphical representation of the effect of coating weight on acceptable moisture.

Referring to FIG. 9, the data in FIG. 8 can be represented to show the acceptable moisture level as a function of the weight percentage of oil. FIG. 9 show a monotonically decreasing moisture percentage is acceptable as the percentage of oil coating increases, yielding an inverse relationship.

The relationship in FIG. 9 can be described according to the inequality:

$$C<30M+5$$

Wherein C is the weight percentage of oil coating on the tow fibers 14, and

M is the weight percentage of moisture in the tow fibers 14, and 0.5<M<1.7% for an oil coating of about 6<C<15%.

A preferable approach to FIG. 8 shows the relationship can be described according to the inequality:

$$C<40M-15$$

Wherein C is the weight percentage of oil coating on the tow fibers 14, and

M is the weight percentage of moisture in the tow fibers 14, and 0.5<M<1.7% for an oil coating of about 6<C<15.

Referring to FIG. 9, these data are re-plotted in a single line interpolating between 7.5 and 15% oil coating weight. It can be seen that the percentage of oil which gives acceptable residue performance monotonically decreases as a function of moisture in the tow fibers 14.

The relationship in FIG. 9 can be described according to the inequality:

$$M<-0.05C+2$$

Wherein C is the weight percentage of oil coating on the tow fibers 14, and

M is the weight percentage of moisture in the tow fibers 14, and 0.5<M<1.7% for an oil coating of about 6<C<15%.

More particularly the coating percentage may be 10<C<50.

Thus for a cleaning article 10 having tow fiber with an oil coating of about 6 to about 15% disposed thereon, the tow fibers may further have about 0.5 to about 1.3 weight percent moisture, and more particularly, 0.75 to 1.3 weight percent moisture.

Applicant has further investigated the effect of oil coating weight on ultrasonic bonding of the tow fibers to the carrier sheet 12. Ultrasonic bonding was elected as the preferred bonding method for making the cleaning article 10, due to high speed manufacturing capability and the availability of commercially available ultrasonic bonding equipment.

Cleaning articles 10 were prepared as described above. Each cleaning article 10 had tow fibers with 0, 6, 9, 12 and 15% coating weight. This experiment was run for n=3 samples of each test. The tow fibers were ultrasonically bonded using commercial equipment. The bonds 38 were then counted and judged to either be acceptable, having bond 38 integrity or to be missing and unacceptable.

Bond 38 integrity would be expected to decrease as a function of oil coating weight. The oil coating would be expected to function as a contaminant, and impede proper bonding. Ultrasonic bonding requires the creation of friction by vibration between the surfaces to be bonded. Any contaminant present could cause slippage, impeding the friction and degrading the ultrasonic bonding.

Referring to FIG. 9, Applicant has unexpectedly found than bond 38 quality increases with coating weight. Unsuccessful bonding percentage is judged to be more than 10% and particularly more than 20% missing bonds 38. FIG. 9 shows that 0 to 6% oil coating weight produces an unacceptable bonding percentage. An oil coating weight of 8 to 15% and preferably 9 to 15% unexpectedly produces the desired high bonding percentage.

Without being bound by theory, Applicant suggest that semi-crystalline materials such as polyethylene, polypropylene, polyester, nylon, as used for the carrier sheet 12 have a sharp melting point. As such a high level of thermal energy is required to break down the crystalline structure before melting can occur. The semi-crystalline material remains solid until it reaches the melt temperature, where this material rapidly becomes liquid. Subsequent solidification also occurs rapidly due to the sudden recrystallization of the molecules. It is believed that the presence of a lubricant like mineral oil at the cited oil coating weights slows the rapid recrystallization of the molten semi-crystalline polymer, providing increased dwell time. The dwell time allows polymers more time to flow into each other before the bond 38 forms, producing a better bonding percentage Test Method for Oil Coating Weight Percentage Coating, measured as milligrams, is determined by measuring the PNMR (Pulsed Nuclear Magnetic Resonance) spin echo signal resulting from protons present in the coating. The portion of the carrier sheet 12 having tow fibers is divided into 3 equal pieces. Each piece is separately analyzed, and the results from each piece are summed to give total coating of the tow fibers 14. The amount of tow fibers amount is then calculated by subtracting the weight of the carrier sheet 12 using a basis weight measurement.

The following equipment, or equivalent, is used.

| | |
|---|---|
| Pulsed NMR | Maran 23 Pulsed NMR Analyzer with 26 mm Probe. Universal Systems, Solon, OH. |
| Heat Block or Heater/Dry Bath | Capable of holding 15 or more 25 mm diameter glass tubes and heating the lower 2" of the tubes to 65 C. ± 2.0° C. Fisher Isotemp Dry Bath Model 145, Cat. #11-715-100, or equivalent |
| Modular Metal Heat Blocks | Fisher Isotemp. Dry Bath Model 145b Sample Block, 25 mm (need at least 4), Cat. 011715-119 or equivalent. |
| Glass sample tubes, disposable | 25 mm diameter, at least 15 cm in height. VWR catalog number 60825-452 (disposable). Can also use screw top sample tubes VWR # 60827-635 or equivalent. |
| Thermometer | At least 15 cm long Non-magnetic thermometer with a range of at least 0 to 100° C. and a sensitivity of at least ±0.5° C. Fisher Cat. #14-983-10B or equivalent |
| Rubber Stopper | Size 3 one hole. VWR catalog # 59581-200 or equivalent. |
| Forceps, 8" | Narrow enough to fit down 25 mm diameter glass tubes. VWR Catalog #25729-627 or equivalent |
| Plastic or glass stir rod | Narrow and long enough to fit down 25 mm diameter glass tubes. |
| Analytical Balance | Accurate to 0.0001 grams. Mettler Toledo #PG203 or equivalent. (VWR, Cat # 11272-710). |
| Timer | Must have a duration of at least 30 minutes and a resolution of at least ±30 seconds. VWR Catalog # 62344-641 or equivalent. |

Calibration standards are made by placing a known mass of coating on a standard size section of fibers. The fibers are bicomponent comprising about 50:50 PE/PP or PE/PET at a fiber size of about 3.0 decitex. These fibers should be free of any lubricant or other coating beyond usual anti-stat which used in manufacture. Suitable fiber material is Trevira, available from Indorama Ventures Company (Trevira GmbH, Philipp-Reis-Str. 4 D-65795 Hattersheim, Germany).

The uncoated calibration fibers are weighed to yield a quantity of 2.3 g (±0.1 g) and spread onto an area of 10 cm×12 cm. The fibers are tared. A standard mineral oil such as Parol 500P available from Calumet Lubricants of Indianapolis, Ind. is used to generate a calibration curve from about 2% to 25% coating weight in 0.05 g increments, ranging from 0.045-0.575 g. The desired grams of the lubricant to generate a calibration curve are placed in the center of the fibers using a pipet. The mass of the coating added is recorded to the nearest 0.0001 g.

Each sample is folded to ensure that the coating is on the inside of the fibers and the fibers transferred to the bottom of the glass sample tube using forceps. The sample should be wholly contained in the bottom 2.5 cm (1 in) of the tube to get an accurate reading.

The cleaning article 10 is prepared by removing any carrier sheet 12 not bonded to tow fibers 14. The remainder is divided and cut into 3 equal pieces. Each piece is separately analyzed and the results summed to give total level of lubricant on the cleaning article 10.

To determine mg coating weight, three sample tubes are used for each cleaning article 10 to be analyzed. The portion of the cleaning article 10 to be tested is cut into three equal portions. Each portion is folded so that the tow fibers are on the inside. The samples are placed into the tubes using a glass or plastic rod as described above.

A dry bath is equilibrated to 40° C.±2° C. The bath temperature is measured by placing a glass tube containing 5.08 cm of mineral oil and a thermometer into the dry bath. The thermometer is inserted through a one hole stopper in the top of the glass tube. The thermometer tip is completely submerged in the mineral oil without touching the sides or bottom of the glass tube.

A Maran 23 spectrometer and determination of specific instrument parameters, including initial calibration are provided. The dry bath temperature is equilibrated so that the spectrometer magnet is at a temperature of 40+0.5° C. The probe temperature is measured as described for the dry bath.

The following settings are used to measure spin echo response on a Maran 23 instrument, serial number 111698, or equivalent:

| SYSTEM | | APPLICATION | |
|---|---|---|---|
| Parameter | Setting | Parameter | Setting |
| P90 | 6.75 | FW | 100000 |
| P180 | 13.5 | DW | 0.5 |
| Dead1 | 18.0 | SI | 256 |
| Dead2 | 20.0 | NS | 16 |
| SF | 23.00000 | RG | 59.26 |
| 01 | −6588.73 | RD | 2000000 |
| | | Tau | 2000 |
| | | PH1 | 0213 |
| | | PH2 | 0213 |
| | | PH3 | 0011 |
| | | DS | 0 |
| | | RFAO | 100 |

The above parameters are used to measure Spin Echo response for the mineral oil coating on a Maran 23 Instrument, serial number 111698 or equivalent.

1. Place the standards into the heating block/dry bath to equilibrate at 40° C. for a minimum of 15 minutes. The samples should be in the dry bath less than 30 minutes to minimize the risk of thermally related sample losses.
2. Record the current values for the parameters "ol" (offset) and "rg" (gain).
3. Place the standard with the highest coating concentration into the magnet and use it to set the gain and offset.
4. Load the "Hahn" sequence and type ".autool" ("o" the letter o in this command, not zero) to set the frequency offset.
5. When this is complete, set the "rg" value by loading the "Hahn" pulse sequence into the "RInmr" program, set ns=1, then type ".autorg" to run this macro.
6. When this is complete, reset "ns"=16. Record the new values of "rg" and "ol".
7. Collect spin echo data for all your standards using the "Hahn" pulse sequence (type "go" to collect data), process each spectrum with the smoothing function (set SMP to 20, then type "sm" to smooth the data) and save the spectra with unique filenames.
8. A "blank" sample (a tube containing only uncoated substrate material) should also be measured. This sample will be included in the calibration curve as a sample with 0 mg of coating.

9. After all standards have been measured, prepare a calibration curve using the "RIcalibrate" software. Use data points from the center of the spin echo data when analyzing the collected data (approximately points 120-160, these points should be optimized for each individual instrument). The least squares straight line fit to the curve should have a correlation coefficient of 0.99 or better. If it doesn't, check for errors in sample preparation, files names, etc. If the correlation coefficient is still not 0.99 or better, re-prepare the calibration samples.
10. Print out the curve, spreadsheet, fit parameters, slope, y-intercept and correlation coefficient.
11. Finally, create a calibration curve file using the utility in the "RIcalibrate" software.

After calibration, the sample tubes and the Tune Standard are placed into the dry bath for 15 minutes.

1. Run the "RIanalyze" software using the calibration curve file that has been generated.
2. Remove the Tune Standard from the dry bath and insert it into the probe.
3. Use the "auto-tune" button to set the "ol" value for your analysis. Record the "ol" value.
4. Immediately click the "start analysis" button and runa Tune Standard.
5. The Tune Standard must be within ±10% of the expected value before samples can be analyzed.
6. The software will prompt the user to insert, measure and remove the substrate samples. The samples should be in the dry bath less than 1 hour before testing and should be analyzed within 1 minute after removal from the dry bath and being placed in the probe.
7. Samples should not be retested, as results may vary.

Calculations are performed automatically by the "RIanalyse" software. The NMR spin echo response is linearly related to the amount of analyte present. A linear least squares regression of the calibration data is obtained using the "RIcalibrate" software. The regression parameters are provided as:

NMR response=slope*(mg coating/sample)+intercept which, upon rearrangement gives:

(mg coating/sample)=(NMR response−intercept)/slope

These calculations are automatically performed by the operating software to convert the NMR response signal to mg coating weight.

Determination of Tow Weight from Finished Sheet

1. The cleaning article 10 is equilibrated at 20 degrees C. and 45-55 RH for at least 8 hours.
2. The cleaning article 10 is weighed to four decimal points, using an analytical balance.
3. A portion of the carrier sheet 12 not having tow, such as the outboard wings, is weighed, and converted to a basis weight in grams per square meter by division. A 25 mm×25 mm portion, or larger, is suitable.
4. The basis weight and area of the cleaning article 10 are multiplied, to yield the total weight of the carrier sheet 12.
5. The weight of the carrier sheet 12 is subtracted from the weight of the cleaning article 10 to yield the weight of the tufts 29T.
6. The uncoated tow weight for a sample from the oil extraction step=Total weight (of piece) minus non-woven weight minus the weight of the oil determined for the piece in oil extraction step.

Three samples are tested and the results averaged to yield the total mg of coating for the cleaning article 10.

Coating weight percentage is then determined by the equation:

Weight percentage of coating per weight of tow=(Total coating weight in grams/weight of total tow used in sheet)×100%.

For example, a cleaning article 10 having 10 g of tow fibers 14 and 0.5 g of coating has a coating of 5 weight percent.

Test Method to Determine Moisture Content of Tow Fibers 14

A cleaning article 10 is provided. The cleaning article 10 is equilibrated to 20 degrees C. and 45-55% RH for at least 8 hours.

A portion of the cleaning article 10 not having tow fibers is removed and weighed. This portion may be approximately 25 mm×25 mm. This weight is converted to a basis weight of gsm by simple division.

The weight of the carrier sheet 12 of the remaining portion of the cleaning article 10 is calculated, based upon the total carrier sheet 12 area. The cleaning article 10 is weighed in a sealable plastic bag and the weight of the carrier sheet 12 subtracted, to yield the weight of the tow fibers 14.

The cleaning article 10 is immediately placed on the center rack of an oven held at 105 to 110 degrees C. for 90 minutes with the tow fibers 14 facing upwards. After 90 minutes the sample is removed and immediately sealed in the plastic bag.

The sample is re-weighed while still warm and weight recorded to 4 decimal places. The dry sheet 12 weight is subtracted from the initial weight to determine moisture percentage according to the formula:

[Initial Sheet Weight(pre-oven)−Dried Sheet Weight (post oven)/Initial Sheet weight]*100.

This procedure is repeated for three samples, and the results are averaged.

Figure 10:
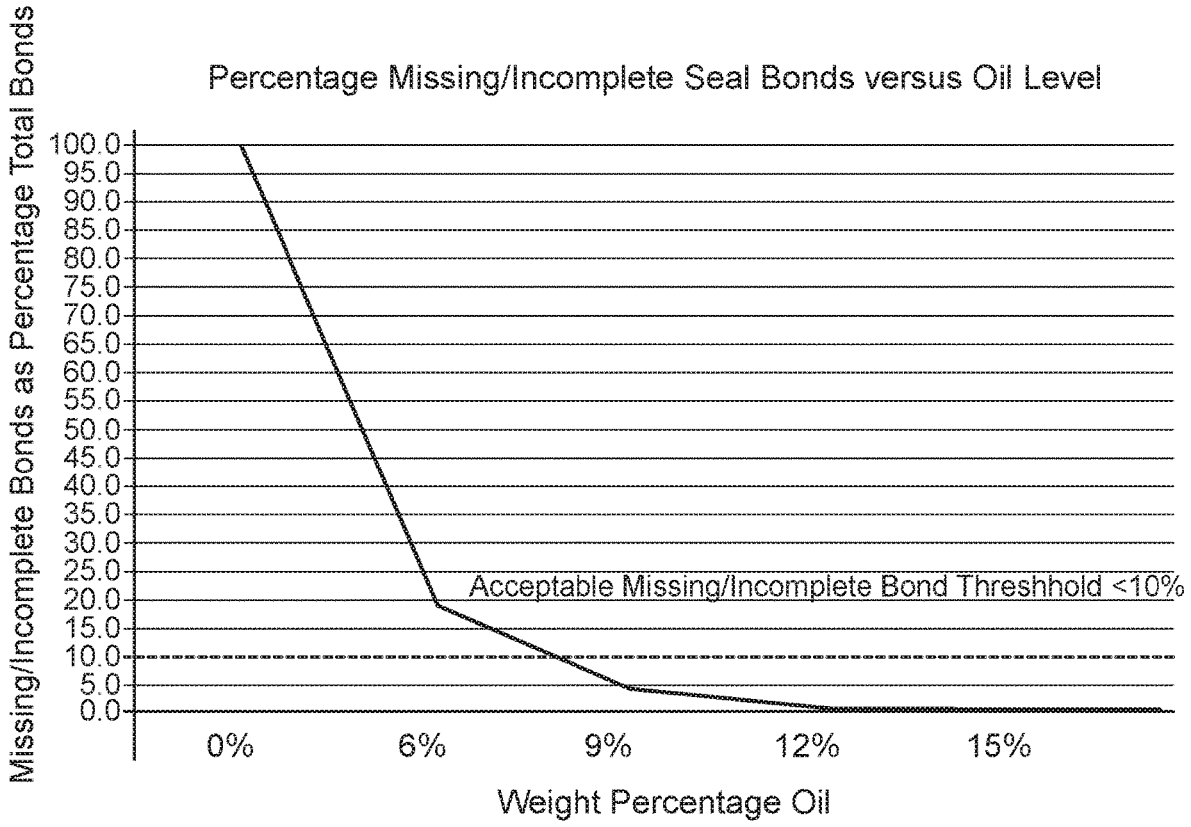
FIG. 10 is a graphical representation of the effect of oil on bond integrity.

Referring to FIG. 10, the cleaning article 10 may be removably attachable to a handle 60. Particularly, an attachment system may provide for removable attachment of the cleaning article 10 to a suitable and optional handle 60. The cleaning article 10 attachment system and optional complementary handle 60 attachment may comprise adhesive joining, cohesive joining, mechanical engagement through sleeves 58, etc. One common attachment system comprises sleeves 58 into which the tine[s] of the handle 60 may be inserted. Suitable handles 60 are disclosed in commonly assigned U.S. Pat. Nos. 8,578,564 and D674,949 S.

Referring to FIGS. 11A and 11B, the cleaning article 10 may be removably attachable to an implement 70 for use with dry, wet and/or prewetted cleaning depending upon the particular task.

If desired, the cleaning article 10 may optionally be used with a cleaning solution or other solution usable for other purposes such as treating the surface for appearance or disinfectant, etc. The cleaning solution may be pre-applied to the cleaning article 10, creating a pre-moistened cleaning article 10 or may be contained within a separate reservoir for dosing onto the cleaning article 10 and/or target surface. The cleaning solution may comprise a majority water, and at least about 0.5, 2, 5 or 10 weight percent solids, or at least about 30 or 50 weight percent aqueous solvents, non-aqueous solutions or mixtures thereof.

Particularly, a floor cleaning implement 70 may allow for cleaning of the floor while the user is upright, and may also provide for spraying of cleaning solution or other liquid to the floor. A typical floor cleaning implement 70 has a handle 72 for grasping by the user and a head 74 attached thereto, and preferably pivotally attached thereto. The head 74 moves against the floor, or other target surface. The cleaning article 10 may be removably attached to the bottom of the head 74. The strips 17 may be bounded by the footprint of the head 74 in use, promoting dynamic movement of the strips 17 during cleaning. In FIG. 5A, the cleaning article 10 has strips disposed on one side only and oriented in a chevron pattern. The other side is free of and does not have strips 17.

Removable attachment of the cleaning article 10 to the implement 70 may be accomplished using adhesive, hook and loop systems, and grippers. Grippers and a suitable cleaning implement 70 are disclosed in commonly assigned U.S. Pat. No. 6,484,356. A suitable implement 70 having an optional vacuum is disclosed in U.S. Pat. No. 7,137,169. Suitable spray implements 70, as shown in FIG. 5B are disclosed in commonly assigned U.S. Pat. Nos. 5,888,006; 5,988,920; 6,842,936; 7,182,537; 7,536,743; 7,676,877 and 8,186,898.

If desired, the cleaning article 10 may be used with and removably attached to an autonomously moving robot or drone. Suitable examples of robots and drones for use with the cleaning article of the present invention are found in commonly assigned U.S. Pat. Nos. 6,941,199; 6,810,305; 6,779,217; 6,481,515; 6,459,955 and Ser. No. 14/992,195, filed Jan. 11, 2016, P&G Case 14189. Examples of robots for use with wet and dry cleaning are found in U.S. Pat. Nos. 7,389,156; 8,774,966 and 8,855,813. A data control system may be utilized with the cleaning article 10, as described in U.S. Pat. No. 7,431,524.

The cleaning article 10 may also be used manually, without a handle 60 or implement 70. If desired, various cleaning articles 10 described herein may be packaged and sold in a kit. This arrangement provides the benefit that the user has a choice of different cleaning articles 10 for different tasks. For example, if desired, plural sizes of the cleaning articles 10 may be sold together as a single kit. This arrangement allows the user to select the particular cleaning article 10 best suited for the immediate task.

Combinations

Without limitation, the invention may be made according to any of paragraphs A-T, or in other embodiments as well.

A. A cleaning article 10 for cleaning a target surface, said cleaning article 10 comprising:

a carrier sheet 12 having a first surface and second surface opposed thereto;

and a tow fiber bundle joined to said first surface of said carrier sheet 12, said tow fiber bundle having an oil coating of about 6 to about 15 w % disposed thereon, said tow fiber bundle having about 1.5 weight percent moisture or less.

B. A cleaning article 10 according to paragraph A said tow fiber bundle having an oil coating of about 9 to about 15 weight percent disposed thereon.

C. A cleaning article 10 according to paragraphs A or B said tow fiber bundle having an oil coating of about 9 to about 13.5 weight percent disposed thereon.

D. A cleaning article 10 according to paragraphs A, B or C said tow fiber bundle having an oil coating of about 6 to about 15 weight percent disposed thereon, wherein said coating consists essentially of oil and is free of wax.

E. A cleaning article 10 according to paragraphs A, B, C or D said tow fiber bundle having an oil coating of about 6 to about 15 weight percent disposed thereon, wherein said coating consists essentially of mineral oil.

F. A cleaning article 10 according to paragraphs A, B, C, D or E said tow fiber bundle having an oil coating of about 6 to about 15 weight percent disposed thereon, wherein said coating consists essentially of mineral oil and nonionic surfactant.

G. A cleaning article 10 according to paragraphs A, B, C, D, E or F said tow fiber bundle having an oil coating of about 9 to about 13.5 weight percent disposed thereon, wherein said coating consists essentially of 80 to 97 percent mineral oil and balance nonionic surfactant.

H. A cleaning article 10 for cleaning a target surface, said cleaning article 10 comprising:

a carrier sheet 12 having a first surface and second surface opposed thereto;

and a tow fiber bundle joined to said first surface of said carrier sheet 12, said tow fiber bundle having an oil coating of about 6 to about 15 w % disposed thereon, said tow fiber bundle further containing a moisture level bounded by the inequality:

$$M<-0.05C+2$$

Wherein C is the weight percentage of coating on said tow, and

M is the weight percentage of moisture in the tow fiber bundle, and $0.5<M<1.7$.

I. A cleaning article 10 according to paragraph H wherein $10<C<50$.

J. A cleaning article 10 according to paragraphs H and I, said tow fiber bundle having an oil coating of about 6 to about 15 weight percent disposed thereon, said tow fiber bundle further containing 0.5 to 1.3 weight percent moisture.

K. A cleaning article 10 according to paragraphs H, I and J, said tow fiber bundle having an oil coating of about 6 to about 15 weight percent disposed thereon, said tow fiber bundle further containing 0.5 to 1.3 weight percent moisture wherein said tow fiber bundle comprises a plurality of individual tufts 29T.

L. A cleaning article 10 according to any preceding paragraphs wherein said tow fiber bundle comprises a plurality of individual tufts 29T, each said tuft having substantially the same coating percentage.

M. A cleaning article 10 according to paragraph L wherein said tow fiber bundle comprises a plurality of individual tufts 29T, each said tuft having substantially the same coating percentage, said oil coating having a surface energy of 22 to 30 mN/m.

N. A cleaning article 10 according to paragraph M wherein said tow fiber bundle comprises a plurality of individual tufts 29T, each said tuft having substantially the same coating percentage, said oil coating having a surface energy of less than 28 mN/m.

O. A cleaning article 10 for cleaning a target surface, said cleaning article 10 comprising:

a carrier sheet 12 having a first surface and second surface opposed thereto;

and a tow fiber bundle joined to said first surface of said carrier sheet 12, said tow fiber bundle having an oil coating of about 6 to about 15 w % disposed thereon, said tow fiber bundle further containing a moisture level bounded by the inequality:

$$C<30M+5$$

Wherein C is the weight percentage of oil coating on the tow fibers 14, and

M is the weight percentage of moisture in the tow fibers 14, and 0.5<M<1.7% for an oil coating of about 6<C<15%.

P. A cleaning article 10 according to paragraph O wherein C<40M−15.

Q. A cleaning article 10 according to any preceding paragraph having a longitudinal centerline and said tow fiber bundle comprises an elongate ribbon of tow fibers 14.

R. A cleaning article 10 according to paragraph Q having a longitudinal centerline and said tow fiber bundle comprises an elongate ribbon of tow fibers 14 disposed generally parallel to said longitudinal centerline, said tow fiber bundle having substantially the same coating weight percentage throughout and further comprising a cleaning strip element comprising a plurality of strips, said cleaning strip element having a first surface and second surface opposed thereto, said strips being defined by slits therebetween, each strip extending from a respective proximal end juxtaposed with said elongate ribbon of tow fibers 14 to a respective distal end remote therefrom.

S. A cleaning article 10 according to any preceding paragraph wherein said tow fibers 14 comprise discrete tufts 29T, said cleaning article 10 being removably attached to an implement 70 suitable for use on a floor.

T. A cleaning article 10 according to paragraphs A, B, C, D, E, F, G, H, I, J, K, L, M, N, O, P, Q or R having a longitudinal centerline, wherein said second side of said cleaning article 10 further comprises at least one longitudinally oriented sleeve 58, said sleeve 58 being suitable for removably receiving a complementary tine of a handle 60 for manipulation of said cleaning article 10 by a user.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm." All percentages are in weight percent.

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cleaning article for cleaning a target surface, said cleaning article comprising:

a carrier sheet having a first surface and second surface opposed thereto; and a tow fiber bundle joined to said first surface of said carrier sheet, said tow fiber bundle having an oil coating of about 6 to about 15 w % disposed thereon, said tow fiber bundle further containing a moisture level bounded by the inequality:

$$M<-0.05C+2$$

Wherein C is the weight percentage of coating on said tow, and

M is the weight percentage of moisture in the tow fiber bundle, and 0.5<M<1.7, wherein said tow fiber bundle comprises a plurality of individual tufts, each said tuft having substantially the same coating percentage, said oil coating having a surface energy of less than 28 mN/m.

2. A cleaning article according to claim 1, said tow fiber bundle having an oil coating of about 6 to about 15 weight percent disposed thereon, said tow fiber bundle further containing 0.5 to 1.3 weight percent moisture.

3. A cleaning article according to claim 1, said tow fiber bundle having an oil coating of about 6 to about 15 weight percent disposed thereon, said tow fiber bundle further containing 0.5 to 1.3 weight percent moisture wherein said tow fiber bundle comprises a plurality of individual tufts.

* * * * *